US005860170A

United States Patent [19]

Witt

[11] Patent Number: 5,860,170

[45] Date of Patent: Jan. 19, 1999

[54] TOILET PLUNGING SHIELD

[76] Inventor: Steve A. Witt, 4209 Sonora Dr., Pasco, Wash. 99301

[21] Appl. No.: 968,021

[22] Filed: Nov. 12, 1997

[51] Int. Cl.[6] ..... E03D 9/00

[52] U.S. Cl. ..... 4/300.3; 4/255.01

[58] Field of Search ..... 4/253, 255.01, 4/300.3, 661; D23/303, 310, 311

[56] References Cited

U.S. PATENT DOCUMENTS

| | | | |
|---|---|---|---|
| 4,458,368 | 7/1984 | Webb | 4/300.3 X |
| 4,831,669 | 5/1989 | Edwards | 4/257 |
| 4,922,555 | 5/1990 | Bonilla et al. | 4/300.3 X |
| 5,099,527 | 3/1992 | Roose | 4/255 |
| 5,353,442 | 10/1994 | Rotter | 4/255 |
| 5,375,270 | 12/1994 | Demers, Jr. et al. | 4/300.3 X |
| 5,600,856 | 2/1997 | Kang | 4/255 |
| 5,706,528 | 1/1998 | Broback | 4/255.01 X |

*Primary Examiner*—Charles E. Phillips
*Attorney, Agent, or Firm*—Floyd E. Ivey

[57] ABSTRACT

A shield is disclosed for use in preventing water from splashing from a toilet bowl when using a plunger in attempting to unplug a clogged toilet or toilet drain. The shield is a resilient single piece construction having at the outer rim a flat portion providing a positioning surface against the upper rim of a toilet bowl; the central portion is dome shaped presenting a concave surface to the inside of a toilet bowl; intermediate the positioning surface and the dome is an annular rim extending downwardly from the positioning surface toward the toilet bowl interior and adjacent to the interior of the upper rim of the toilet bowl and thence upwardly to form the dome. An aperture is positioned generally centrally in the dome with the aperture accepting the handle of a toilet plunger; the aperture forming a frustrum or truncated conical passage way, for the toilet handle, extending downwardly from the dome. The positioning surface provides a foundation against the toilet rim and a sealing function against splashing water. The annular rim and dome shaped central portion direct splashing water toward the center of the dome and away from the rim. The downwardly extending frustrum complements the dome in reducing access passage ways for the escape of water from the toilet bowl when operating the toilet plunger. The operator may secure the apparatus in place with his or her foot while operating the plunger thus increasing the sealing effect of the positioning surface and stabilizing the apparatus while plunging.

5 Claims, 4 Drawing Sheets

TOILET PLUNGING SHIELD

FIELD OF THE INVENTION

The present invention relates generally to the reduction of the splashing of water from a toilet bowl during the operation of a toilet plunger and particularly to a shield used to prevent water from splashing from a toilet bowl when using a plunger in attempting to unplug a clogged toilet or toilet drain.

BACKGROUND OF THE INVENTION

Apparatus directed to the reduction of the splashing of liquids, including water, from toilet bowls during operation of a toilet plunger are known in the prior art including U.S. Pat. No. 4,831,669 to Edwards; U.S. Pat. No. 5,099,527 to Roose; U.S. Pat. No. 5,353,442 to Rotter and U.S. Pat. No. 5,600,856 to Kang. The patents referred to herein are provided herewith in an Information Disclosure Statement in accordance with 37 CFR 1.97.

SUMMARY OF THE INVENTION

The present invention discloses the use of a shield to prevent water from splashing from a toilet bowl when using a plunger while attempting to unplug a clogged toilet or toilet drain. The shield is a disk constructed from resilient material in a single piece. At an outer rim a flat portion provides a positioning surface for the apparatus against the upper rim of a toilet bowl. The disk apparatus has a central portion which in the preferred embodiment is dome shaped presenting a concave surface to the toilet bowl interior. The positioning surface and dome are joined by an annular rim, intermediate the positioning surface and the dome, which extends, in the preferred embodiment, downwardly from the positioning surface toward the toilet bowl interior and adjacent to the interior of the upper rim of the toilet bowl to a connection with the dome. An aperture is positioned generally centrally in the dome with the aperture accepting the handle of a toilet plunger. The aperture forms a frustrum or truncated conical passage way, for the toilet handle, extending downwardly from the dome. The positioning surface provides a foundation against the toilet rim and a sealing function against splashing water. The annular rim and dome shaped central portion direct splashing water toward the center of the dome and away from the rim. The downwardly extending frustrum complements the dome in reducing access passage ways for the escape of water from the toilet bowl when operating the toilet plunger. The operator may secure the apparatus in place with his or her foot while operating the plunger thus increasing the sealing effect of the positioning surface and stabilizing the apparatus while plunging. The dome may be other than concave in its presentation to the toilet bowl. The inner surface of the dome will slope down from the central portion to the annular rim. Thus the inner surface may be conical in form. The annular rim may form a 'vee' shape extending downwardly from the positioning surface to an apex and then upwardly to connection with the dome. Means are provided at the perimeter to accommodate different toilet seat connection schemes including forming a portion of the perimeter in a straight or flat line or providing holes or slots to accommodate particular toilet seat fastening elements.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
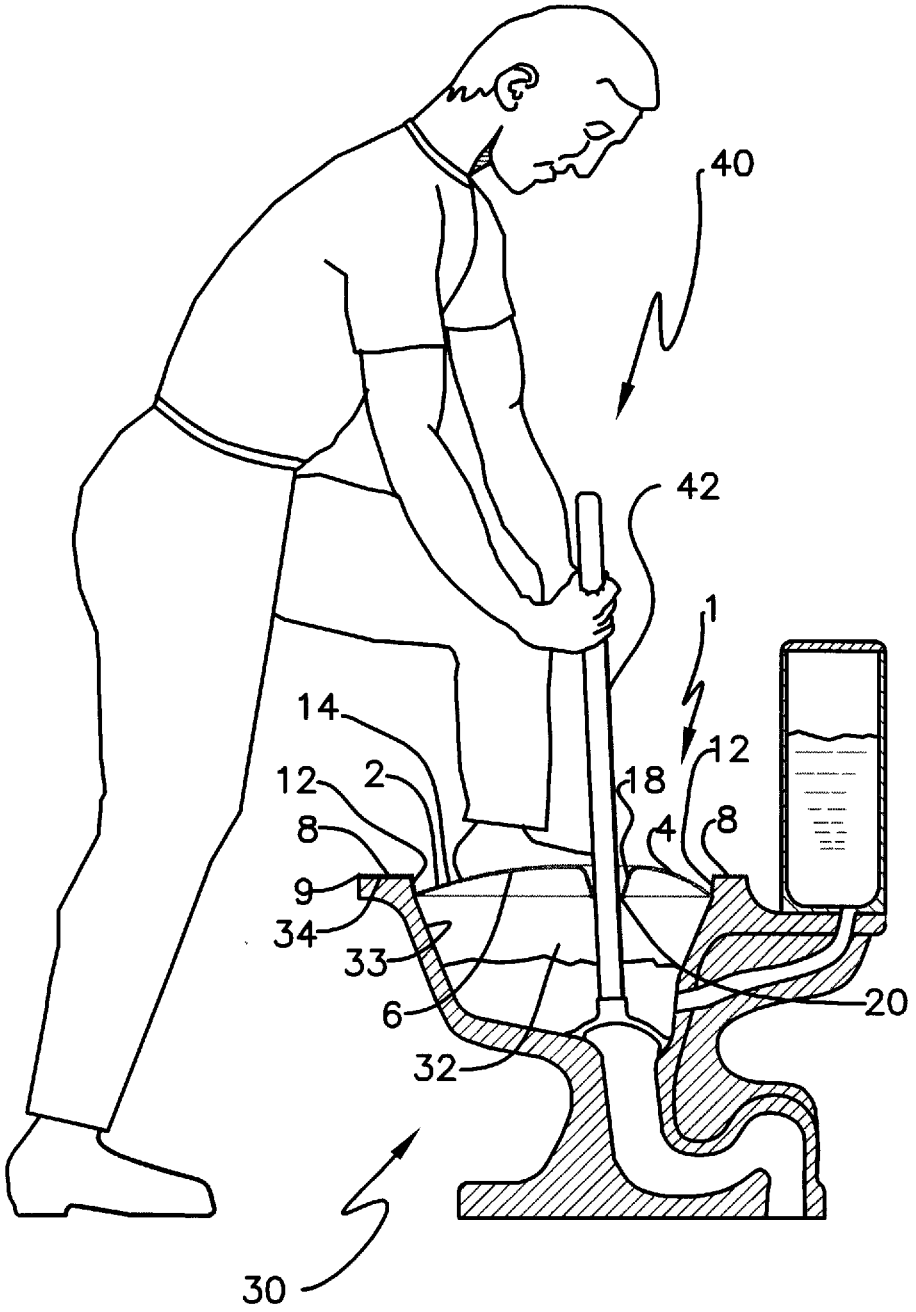
FIG. 1 is a side section elevation of a toilet showing a section view of the toilet plunging shield with outer and inner surfaces with an outer rim. The outer rim at the inner surface forms the positioning surface which rests against the upper rim of the toilet bowl; illustrated is the annular rim and dome with downwardly extending frustrum and plunger handle aperture accommodating a toilet plunger handle. The operator is depicted stabilizing the apparatus and increasing the sealing function of the positioning surface with the pressure of his weight.
Figure 4:
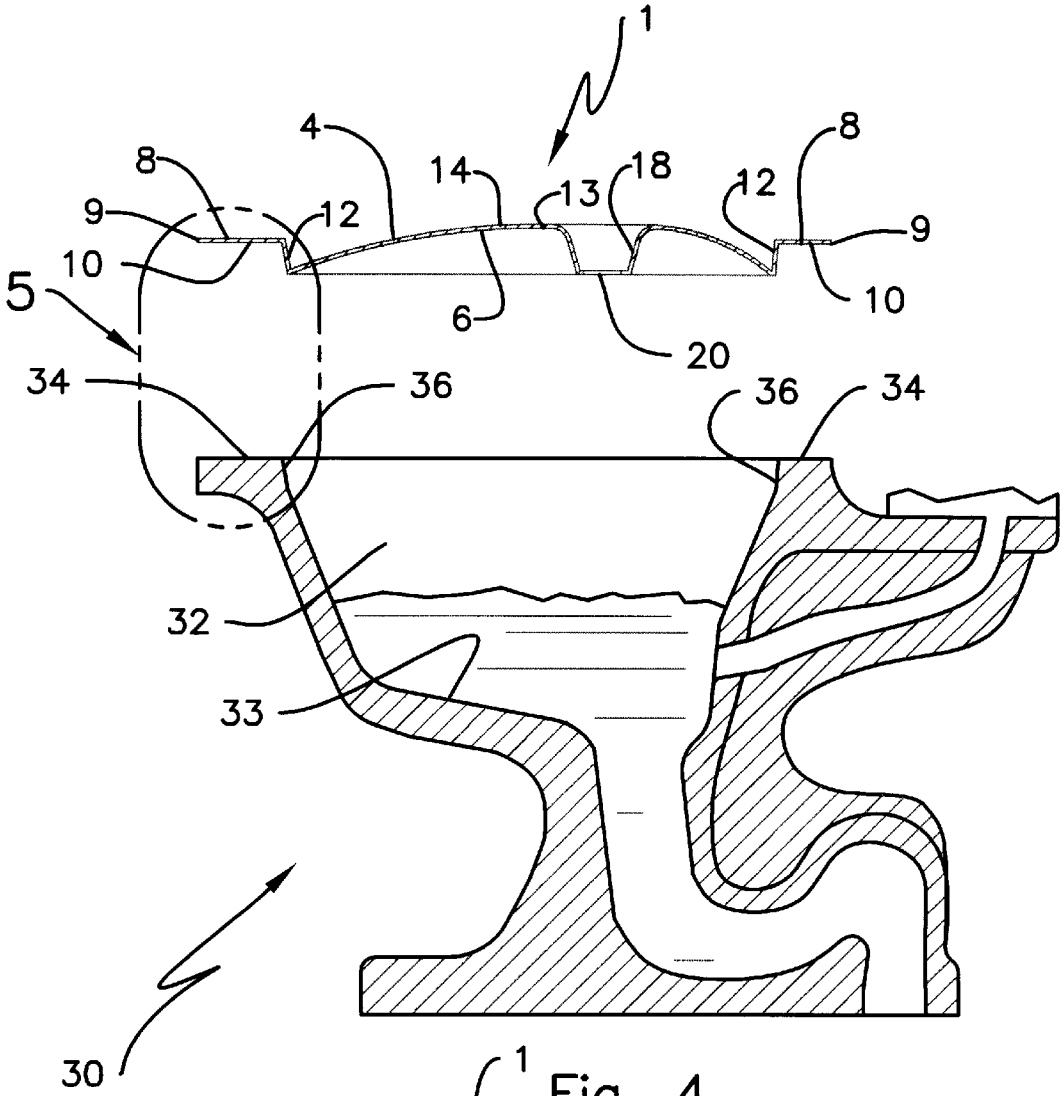
FIG. 4 is a side section elevation of a toilet illustrating the toilet bowl, the toilet bowl interior, the upper rim and upper rim interior surface. Shown in side section elevation view is the toilet plunging shield separated from and above the toilet. Depicted are the toilet plunging shield outer and inner surfaces, perimeter, outer rim, positioning surface, annular rim, dome, frustrum and plunger handle aperture. The positioning surface and annular rim are shown respectively in relation to the upper rim and the upper rim interior surface. Illustrated is the dome with centrally positioned plunger handle aperture and downwardly extending frustrum.
Figure 5:
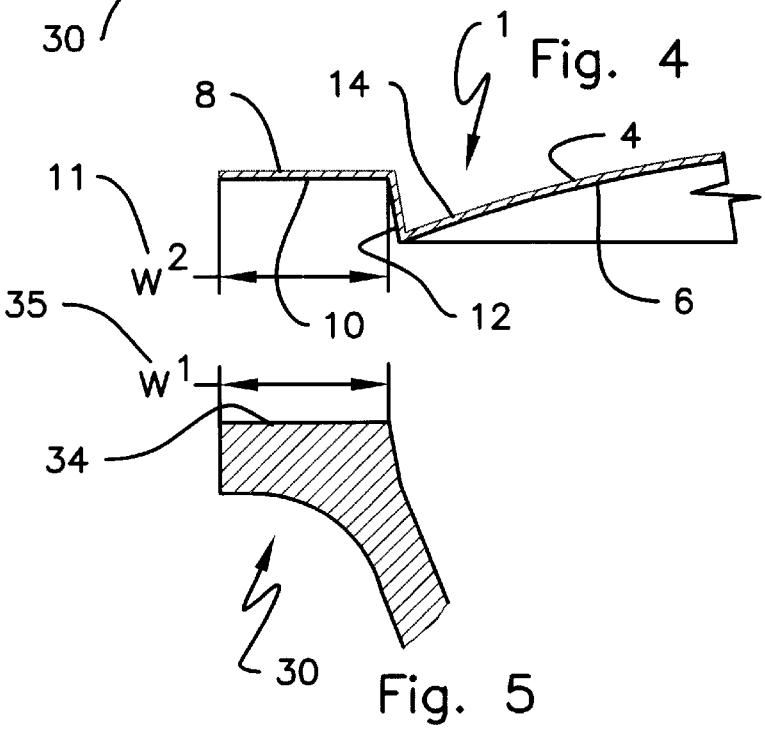
FIG. 5 is a detail from FIG. 4 showing the relationship between the positioning surface and positioning surface width and the upper rim and upper rim width.

The preferred embodiment of the toilet plunging shield 1 disclosed herein is depicted in FIG. 1, 2, 3 and 4. A toilet 30, shown in FIG. 1 and 4, has a toilet bowl 32 having a toilet bowl interior 33. The toilet bowl 32 has an upper rim 34. The upper rim 34 has an upper rim interior surface 36 extending downwardly toward the toilet bowl interior 33 as shown in FIG. 1 and 4. The toilet plunger shield 1 is a single piece construction disk 2 formed from resilient material, including for example plastics, having an outer and inner surface 4, 6 and a perimeter 9. The toilet plunging shield 1 may be formed in an injection molding process. An outer rim 8 proximal to the perimeter 9, forms, at the inner surface 6, a positioning surface 10 which will rest sealably upon the toilet bowl upper rim 34 and additionally provide support at the upper rim 34 for the apparatus during use. Sealant means, including for example a latex or rubber coating, may be affixed to the positioning surface 10. The positioning surface 10 will be generally flat to match the generally flat surface of the upper rim 34 which has a width "w1" 35. The positioning surface 10 has a positioning surface width "w2" 11 bounded at one extremity by the perimeter 9 and the other extremity distal from the perimeter 9 by the annular rim 12 connection with the positioning surface 12 with the positioning surface width "w2" 11 approximating the width "w1" 35 of an upper rim 34.

The dome 14 central portion 13 of the disk 2 is dome shaped and, in the preferred embodiment, presents a concave surface to the toilet bowl 32 and toilet bowl interior 33. An annular rim 12 is formed intermediate the positioning surface 10 and the dome 14 joining the outer rim 8 and the dome 14. The annular rim is formed 12 at the extremity of the positioning surface 10 which is most distal from the perimeter 9 extending downwardly from the positioning surface 10 toward, when in use, the toilet bowl interior 33 and terminates in connection with the dome 14. The annular rim 12, when the apparatus is in use, is positioned adjacent to the upper rim interior surface 36.

A plunger handle aperture 20 is positioned generally centrally in the dome extending from the outer to the inner surface 4, 6 with the plunger handle aperture 20 sized to snugly accept a toilet plunger 40 handle 42. The outer and inner surfaces 4, 6 at the plunger handle aperture 20 forms a downwardly extending frustrum 18. Thus the plunger handle aperture 20 is formed as a truncated conical passage way from the outer to the inner surface 4, 6. The frustrum 18 extends downwardly toward the toilet bowl 32 and toilet bowl interior 33 when the apparatus is in use.

Figure 6:
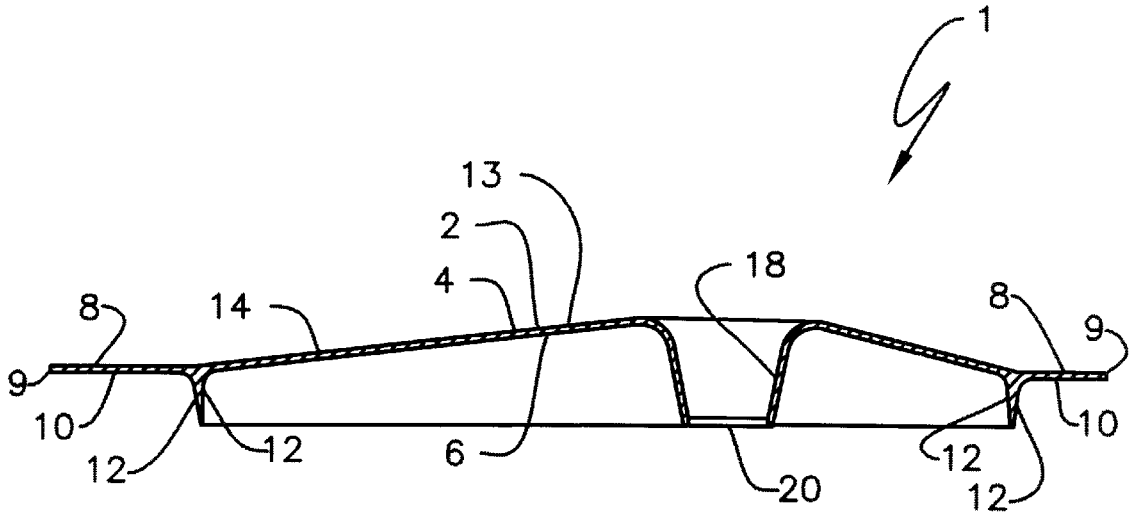
FIG. 6 is a side section elevation of the toilet plunging shield with outer and inner surfaces with an outer rim. The outer rim at the inner surface forms the positioning surface which rests against the upper rim of the toilet bowl; illustrated is the annular rim extending downwardly to an apex forming a "vee" shape with connection with the dome. The dome is illustrated with downwardly extending frustrum and plunger aperture. The dome is depicted as forming a conical shape in contrast with the concave surface of FIG. 3.
Figure 7:
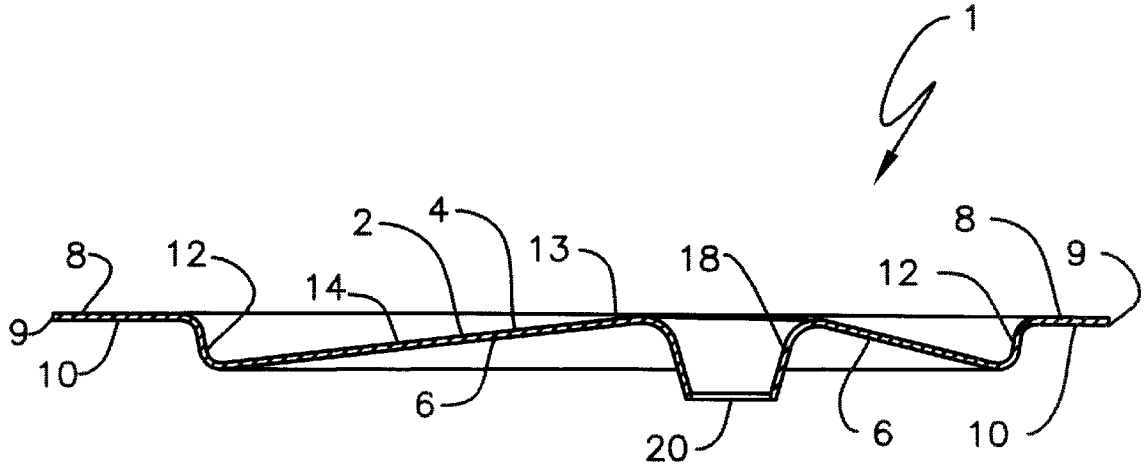
FIG. 7 is a side section elevation of the toilet plunging shield illustrating the annular rim extending downwardly for connection with a dome presenting a conical form to the toilet bowl.

A dome 14 presenting a conical form to the toilet bowl is depicted in FIG. 6. The annular rim 12 is shown in a "vee" form as the connection between the outer rim 8 and the dome 14. FIG. 7 shows a dome 14 in a conical form facing the toilet bowl.

The annular rim 12 and dome 14 shaped central portion 13 directs splashing water toward the center of the dome 14 and away from the upper rim 34. The downwardly extending frustrum 18 complements the dome 14 in reducing access passage ways for the escape of water from the toilet bowl 32 when operating the toilet plunger 40. The operator is depicted, in FIG. 1, stabilizing the apparatus and increasing the sealing function of the positioning surface 10 by placement of his foot against the outer surface 4 during toilet plunger 40 operation.

The dome 14 may be other than concave in its presentation to the toilet bowl 32. The inner surface 6 of the dome 14 will slope down from the central portion 13 to the annular rim 12. Thus the inner surface 6 may be conical in form. The annular rim 12 may form a 'vee' shape extending downwardly from the positioning surface 10 to an apex and then upwardly to connection with the dome 14.

Figure 2:
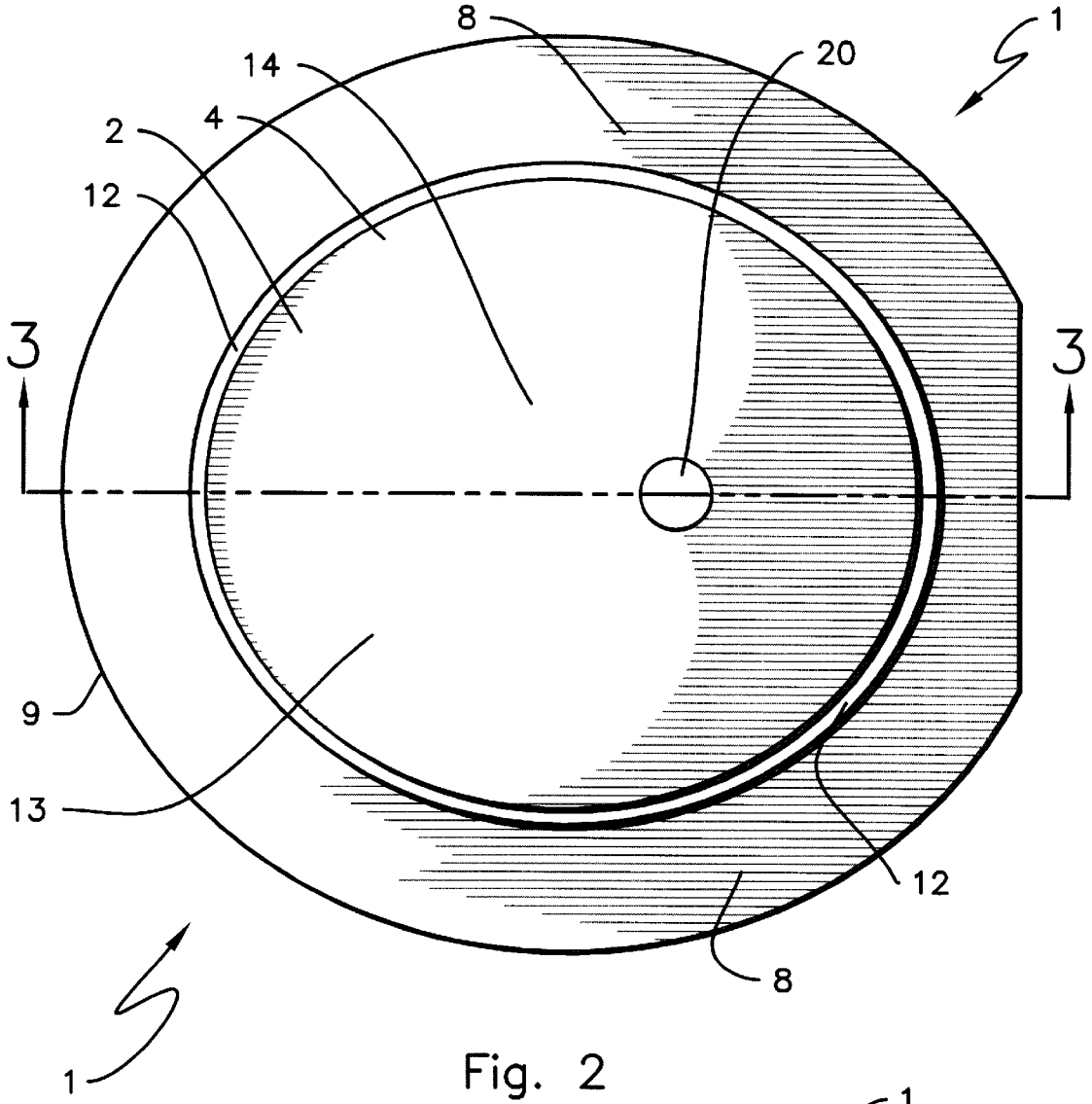
FIG. 2 is a top view of the toilet plunging shield showing the outer surface, the perimeter, the outer rim, annular rim, dome, frustrum and aperture. This view shows a portion of the perimeter as a straight or flat formation demonstrating a means of accommodating toilet seat fastening elements.
Figure 3:
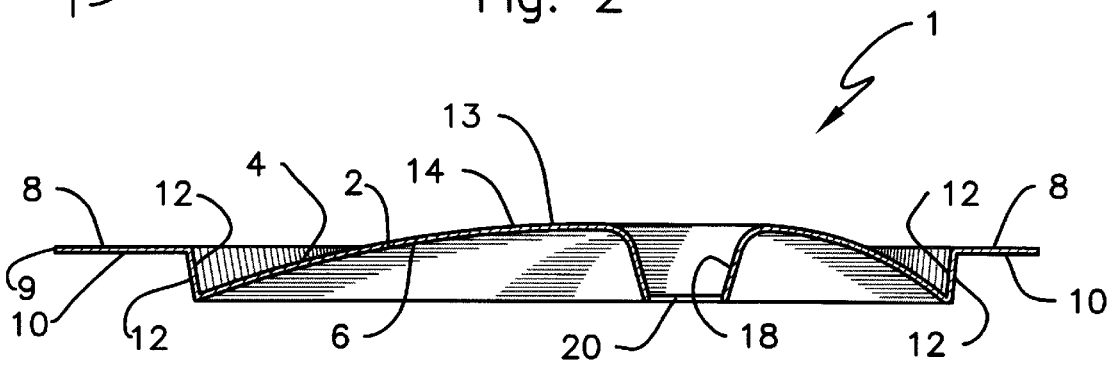
FIG. 3 is a side section elevation of the toilet plunging shield with outer and inner surfaces with an outer rim. The outer rim at the inner surface forms the positioning surface which rests against the upper rim of the toilet bowl; illustrated is the annular rim extending downwardly and dome with downwardly extending frustrum and plunger aperture which accommodates a toilet plunger handle. This view depicts the dome as a concave surface facing the toilet bowl.

Means are provided at the perimeter 9 and outer rim 8, as shown in FIG. 2, to accommodate different toilet seat connection schemes; means including forming a portion of the outer rim 8 at the perimeter 9 in a straight or flat line or providing holes or slots to accommodate particular toilet seat fastening elements.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A toilet plunging shield comprising a. a disk 2 having an outer and inner surface 4, 6 and having a perimeter 9; an outer rim 8 is proximal to the perimeter 9 forming, at the inner surface 6, a positioning surface 10 which will rest sealably upon a toilet bowl upper rim 34 and provide support at the upper rim 34 for the apparatus during use;

b. a central portion 13 of the disk 2 is dome shaped forming a dome 14;

c. a rim 12 is formed intermediate the positioning surface 10 and the dome 14 joining the outer rim 8 and the dome 14; the central portion slopes downwardly below said positioning surface to form said rim, which rim during use is positioned in a toilet bowl adjacent the upper rim;

d. a plunger handle aperture 20 is positioned generally centrally in the dome extending from the outer to the inner surface 4, 6 with the plunger handle aperture 20 sized to snugly accept a toilet plunger 40 handle 42.

2. A toilet plunging shield in accordance with claim 1 further comprising:

a. the disk is formed of a resilient material; the positioning surface 10 is generally flat to match the generally flat surface of the upper rim 34; the positioning surface 10 has a positioning surface width "w2" 11 bounded at one extremity by the perimeter 9 and the other extremity distal from the perimeter 9 by the annular rim 12 connection with the positioning surface 12 with the positioning surface width "w2" 11 approximating the width "w1" 35 of an upper rim 34;

b. the annular rim is formed 12 in the disk 2 at the extremity of the positioning surface width "w2" 11, which is most distal from the perimeter 9, extending downwardly from the positioning surface 10 toward, when in use, the toilet bowl interior 33 and terminates in contact with the dome 14; the annular rim 12, when the apparatus is in use, is positioned adjacent to an upper rim interior surface 36;

c. the outer and inner surfaces 4, 6 at the plunger handle aperture 20 forms a downwardly extending frustrum 18; the frustrum 18 extends downwardly toward the toilet bowl 32 and toilet bowl interior 33 when the apparatus is in use.

3. A toilet plunging shield in accordance with claim 2 further comprising:

a. sealant means affixed to the positioning surface;

b. the dome presents a concave surface to a toilet bowl 32 and a toilet bowl interior 33;

c. means are provided at the outer rim 8 at the perimeter 9 to accommodate different toilet seat connection schemes.

4. A toilet plunging shield in accordance with claim 2 further comprising:

a. sealant means affixed to the positioning surface;

b. the dome presents a conical surface to a toilet bowl 32 and a toilet bowl interior 33;

c. means are provided at the outer rim 8 at the perimeter 9 to accommodate different toilet seat connection schemes.

5. A toilet plunging shield in accordance with claim 2 further comprising:

a. the annular rim 12 forms a 'vee' shape extending downwardly from the positioning surface 10 to an apex and then upwardly to a connection with the dome 14;

b. means are provided at the outer rim 8 at the perimeter 9 to accommodate different toilet seat connection schemes.

* * * * *